US005936202A

United States Patent [19]

Yovan

[11] Patent Number: 5,936,202

[45] Date of Patent: Aug. 10, 1999

[54] DEBRIS PROTECTION COVER ASSEMBLY FOR CABLE CONNECTORS

[75] Inventor: Roger D. Yovan, Fountain Valley, Calif.

[73] Assignee: McDonnell Douglas Corporation, St. Louis County, Mo.

[21] Appl. No.: 08/891,055

[22] Filed: Jul. 10, 1997

[51] Int. Cl.[6] ..... H01R 4/00

[52] U.S. Cl. ..... 174/93; 174/82; 174/74 A; 174/135; 439/294; 439/312; 439/314

[58] Field of Search ..... 174/82, 86, 70 A, 174/97, 135; 439/294, 312, 314

[56] References Cited

U.S. PATENT DOCUMENTS

| | | | |
|---|---|---|---|
| 1,774,091 | 8/1930 | Glawe et al. | 220/326 |
| 2,736,513 | 2/1956 | Amann et al. | 243/39 |
| 3,813,904 | 6/1974 | Wallskog | 70/169 |
| 3,907,155 | 9/1975 | Smith et al. | 220/210 |
| 4,365,858 | 12/1982 | Karol | 339/36 |
| 4,385,792 | 5/1983 | Baur et al. | 339/39 |
| 4,420,012 | 12/1983 | Astrom | 137/319 |
| 4,796,778 | 1/1989 | Habig et al. | 220/315 |
| 4,830,058 | 5/1989 | Harris | 138/89 |
| 4,921,123 | 5/1990 | Mizioch | 220/323 |
| 4,944,424 | 7/1990 | Wood, Jr. | 220/85 |
| 5,439,130 | 8/1995 | Waugh | 220/210 |
| 5,446,823 | 8/1995 | Bingham et al. | 385/135 |

*Primary Examiner*—Hyung-Sub Sough
*Assistant Examiner*—William H Mayo, III
*Attorney, Agent, or Firm*—Brooks & Kushman P.C.

[57] ABSTRACT

A protective cover assembly for an end of a cable connector having a cable housing that encloses a plurality of connective pins or sockets and that satisfies all requirements for space applications. A connector body flange is formed at the extremity of a cable and is positioned so that it may register with a corresponding connector body flange on the end of a companion cable to which a connection is to be made, one cable end having cable lead pins and the companion cable end having lead sockets with which the pins register. A latch mechanism having a latch housing is received in the connector body flange and a crank connected to a manually rotatable cap actuates a spring-loaded latch element that is engageable with a connector body flange to secure or to release the cover assembly with the simple twisting motion of the cap, thereby simplifying the task of effecting coupling and decoupling of the cable ends.

9 Claims, 5 Drawing Sheets

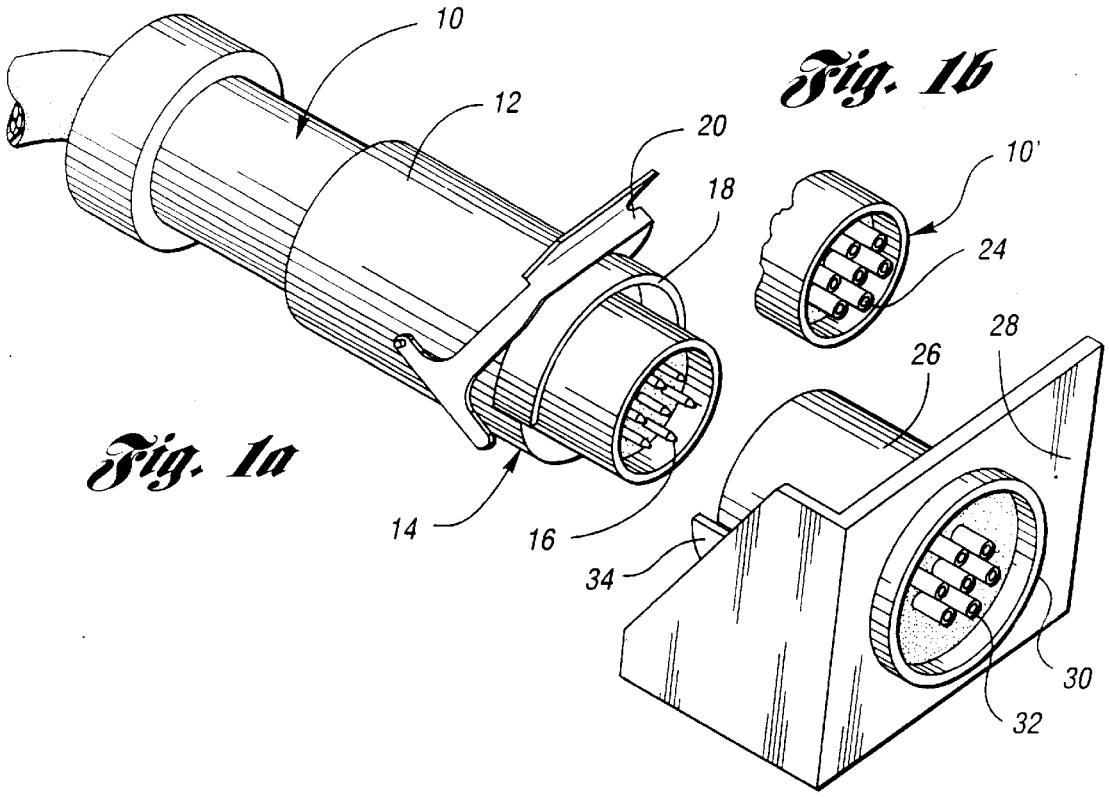
Fig. 1a
Fig. 1b
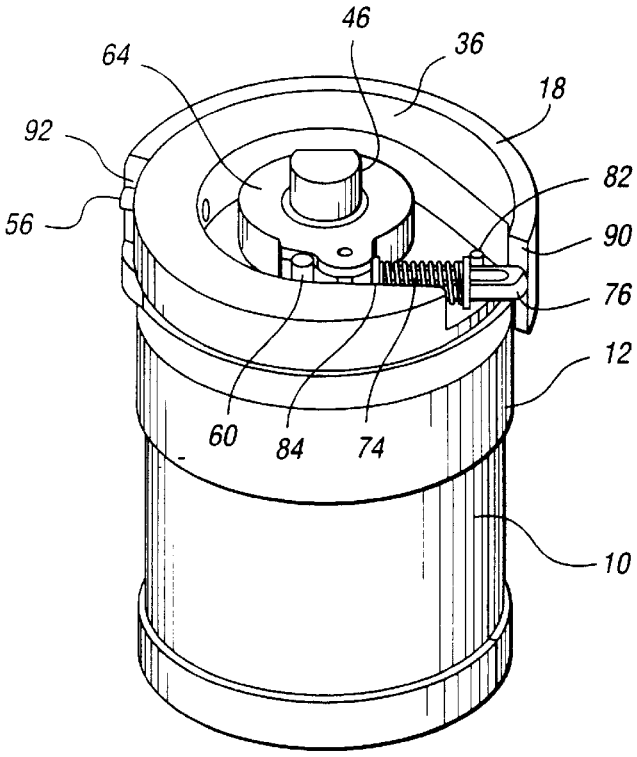
Fig. 1c
Fig. 2

DEBRIS PROTECTION COVER ASSEMBLY FOR CABLE CONNECTORS

STATEMENT OF GOVERNMENT INTEREST

This invention was made with U.S. Government support under Government Contract NAS15-10000 awarded by the National Aeronautics and Space Administration (NASA). The Government has certain rights in this invention.

TECHNICAL FIELD

This invention relates to power cable connectors and to a protective cap assembly for an end of a power cable when it is decoupled from a companion cable.

BACKGROUND ART

In the environment of a space vehicle, it is necessary for an astronaut-occupant to couple and to decouple cables for various purposes as he or she performs occupational spacecraft tasks and operates on-board spacecraft test equipment. It is desirable, in view of the confinement of a spacecraft environment, to simplify as much as possible the task of connecting and disconnecting cable leads and to ensure that reliable connections are established between multiple cable lead pins and sockets in the respective ends of the power cables to be attached.

An astronaut involved in the task of coupling and decoupling cables typically would be protected from the environment of space by a space suit that would include protective gloves. This makes it unfeasible for the astronaut to exert a force to apply or to remove a protective cap for a cable, although it is feasible for the astronaut to apply a torque to a protective cap with simple manual twisting.

It is necessary also in the spacecraft environment for the protective cap for a cable to be of low profile and of minimal radial dimensions because of the space restrictions in the space vehicle environment. A protective cap, furthermore, must be capable of withstanding vibration forces and be self-locking with a simple one-hand operation that does not require the astronaut to exert a cap insertion force.

DISCLOSURE OF THE INVENTION

The invention comprises a debris protective cover assembly for a series connector for a cable having multiple connector lead pins secured within the connector housing. The housing is provided with a connector body flange at its extremity and a latch housing that nests within the connector body flange. The latch housing surrounds a latch operating crank that is drivably connected to a rotary cap that covers the end of the connector housing. The crank, upon rotary motion of the cap, engages a spring that acts on one end of the latch, which is secured within the latch housing. The latch is adapted to move in a generally radial direction with respect to the axis of rotation of the cap.

When the cap is rotated through a predetermined angular displacement, the latch spring will disengage the latch from the connector body flange, thereby permitting the cap assembly to be removed from the end of the connector housing. No axial force need be applied to the cap prior to removal of the cap assembly from the connector housing.

The cover assembly may be reapplied to the end of the connector housing by inserting the latch housing within the connector body flange and by applying a simple twisting motion with minimal torque on the cap as the latch is driven into locking engagement with the connector body flange.

The latch housing and the cap may be applied to the end of the connector housing with a self-centering, one-handed, simple twisting motion without the need for the application of an insertion force. This establishes an automatic anti-vibration, self-locking latch that secures the cap to the end of the connector housing.

The invention as disclosed is a debris protective cover assembly for a cable used in a spacecraft vehicle, but it may be used as well in protecting the ends of power cables during the servicing of spacecraft before launch and during transport of the cables and the spacecraft itself. The invention also may be applied to cables used in environments other than a spacecraft environment.

While an embodiment of this invention is illustrated and disclosed, this embodiment should not be construed to limit the claims. It is anticipated that various modifications and alternative designs may be made without departing from the scope of this invention.

BRIEF DESCRIPTION OF THE DRAWINGS

FIG. 1*a* is an isometric schematic view of a prior art power cable assembly in which a connector body surrounds a cable that has been extended from the connector body flange;

FIG. 1*b* illustrates a cable that contains connector sockets rather than the connector pins as illustrated in FIG. 1*a;*

FIG. 1*c* is a schematic isometric view of a companion connector that is adapted to register with the power connector of FIGS. 1*a* and 1*b;*

FIG. 2 is an isometric assembly view of a protective cover assembly for the end of a cable wherein the cap of the cover assembly has been removed for purposes of clarity;

BEST MODE FOR CARRYING OUT THE INVENTION

Figure 3:
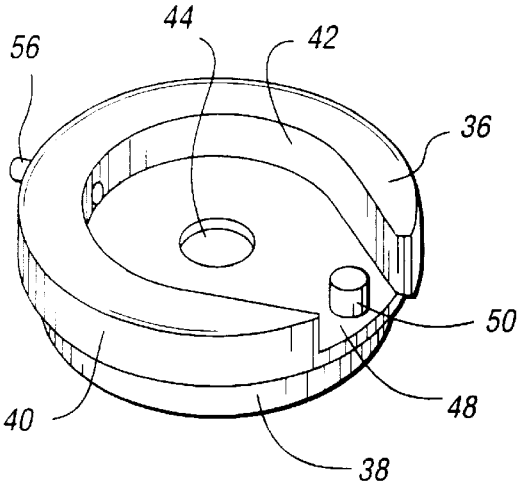
FIG. 3 is an isometric view of the latch housing that is illustrated in the assembly view of FIG. 2.

For the purpose of describing a structural environment, FIGS. 1*a,* 1*b* and 1*c* are included even though they do not illustrate the improvements of the invention. The power connector cable assembly 10 comprises a cable housing 12 which forms a part of a connector plug 14 located at the end of a cable. The cable housing 12 encloses cable pins 16 and has a connector housing flange 18.

The end of the connector assembly 10 illustrated in FIG. 1*a* is extended from the connector plug 14. It is extendable in this fashion by a lever system illustrated generally at 20. The lever system includes a manually adjustable lever that is hinged at 22 on the connector plug 14. An internal mechanism operated by the lever system 20 extends and retracts the connector assembly end. When the cap of the invention is applied to the structure illustrated in FIG. 1*a,* the end of the connector assembly 10 would be retracted within the connector plug 14.

FIG. 1*b* shows the end 10' of another cable assembly for a connector. It differs from the end of the connector of FIG. 1*a,* however, because it includes pin sockets 24 rather than the pins 16 as in FIG. 1*a*. The use of pins or sockets depends upon the particular application. In either case, the protective cap of the invention may be applied to the end of the housing that contains the pins or the sockets.

FIG. 1*c* shows a relatively stationary connector housing 26 which is supported by a fixed bracket 28. The sheath 26 is joined to a cable housing, member partly shown at 30, which contains lead connector sockets 32. When connector housing 12 is joined to connector housing 26, an electrical connection is established between the pins 16 and the sockets 32.

As in the case of the connector plug shown in FIG. 1*a,* the connector housing 26 has a connector housing flange as shown at 34. It is semicircular and is adapted to register with connector housing flange 18 of the plug shown in FIG. 1 when the cable ends are joined together. When assembled, the two semicircular housing flange 18 and 34 form a complete annular flange. The connector protective cover of the invention may be applied to either the connector plug shown in FIG. 1*a* or to the socket member as shown in FIG. 1*c*.

FIG. 2 is an isometric assembly view showing portions of the protective cap of the invention assembled within a connector housing end.

Figure 3A:
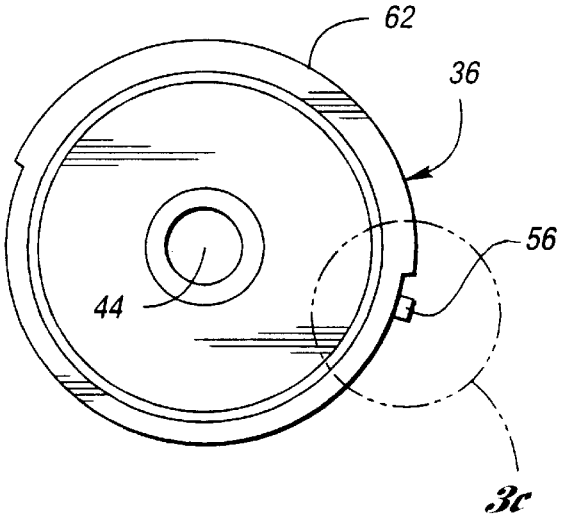
FIG. 3*a* is a top view of the latch housing of FIG. 3.
Figure 3B:
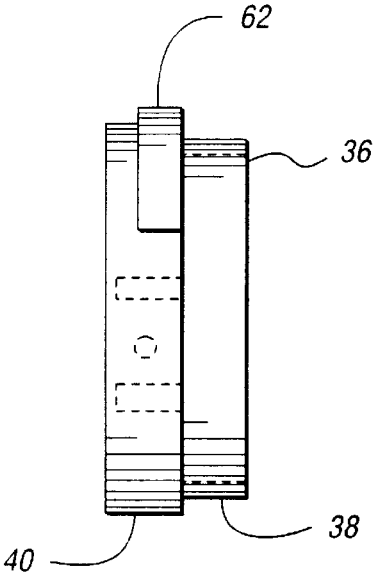
FIG. 3*b* is an end view of the latch housing of FIG. 3*a;*
Figure 9:
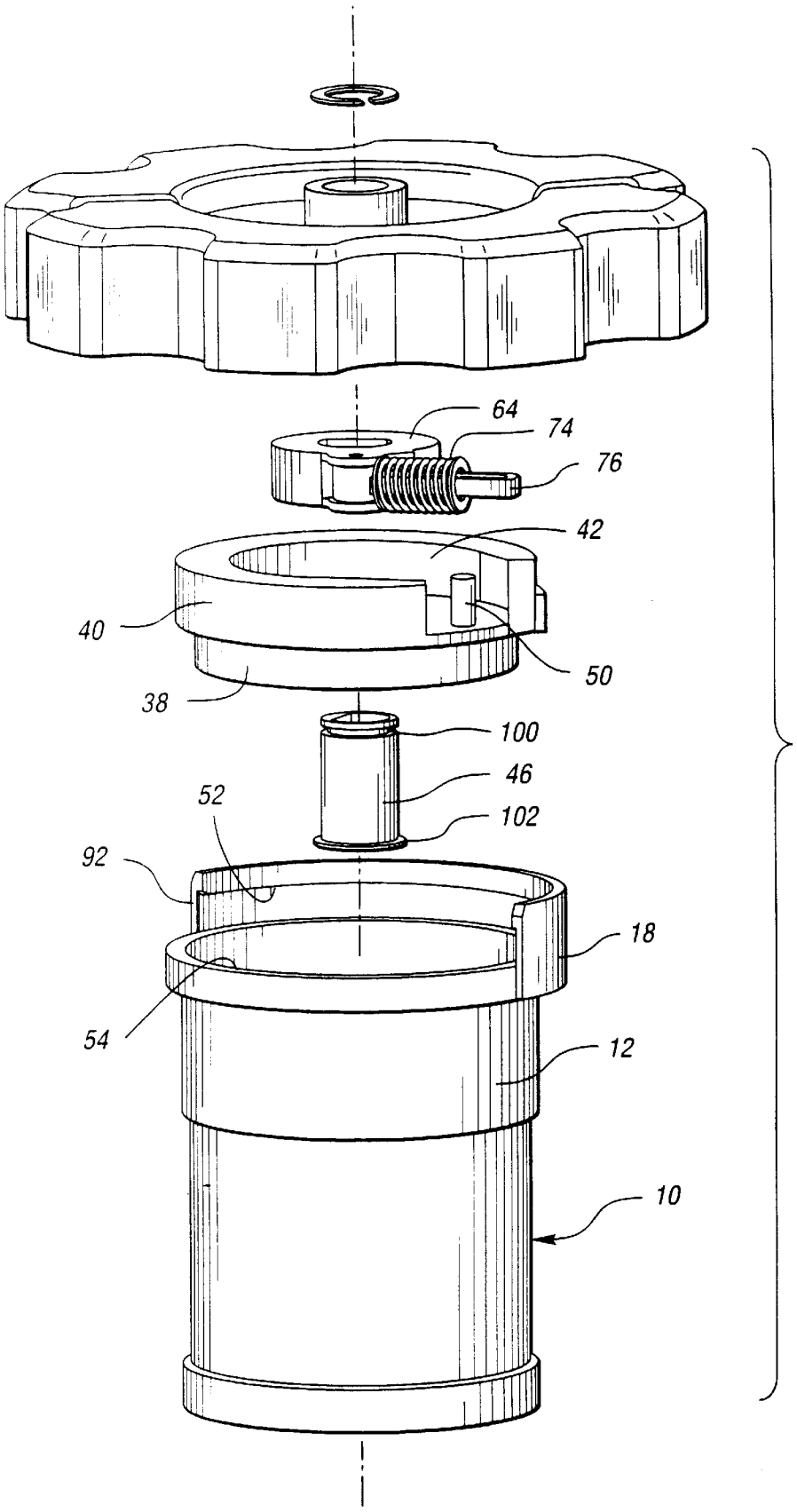
FIG. 9 is an exploded isometric view of the elements of the protective cover assembly illustrated in FIGS. 1–8*a*.

The connector housing flange 18 is semicircular, as explained previously. It receives within its inside diameter a latch housing 36. FIG. 3 and FIG. 3*a,* as well as the exploded view of FIG. 9, show the latch housing 36 in more particular detail. It includes a periphery with differential diameters, the smaller diameter portion being shown at 38 and the larger diameter portion being shown at 40. The latch housing 36 has an interior cavity 42 surrounding a central opening 44, the latter being adapted to receive a pin 46, as seen in FIGS. 2, 6, 6*a* and 9.

The cavity 42 extends through an opening in the peripheral portion 40. An anchor pin 50 extends upwardly from the base 48 of the latch housing 36, the function of which will be described with reference to FIGS. 8 and 8*a*.

As illustrated in FIGS. 2 and 9, the latch housing is inserted in the end of the cable housing 12 within the connector housing flange 18. As seen in FIG. 9, the flange 18 has an internal groove 52. The shoulder formed by the differential diameter portions 38 and 40 of the latch housing 36 rests on the end surface 54 of the cable housing 12. A stop pin 56 extends radially from the latch housing, as best seen in FIG. 3*a*.

As seen in FIG. 2, the stop pin 56 engages one end 92 of the connector housing flange 18 which prevents rotation of the latch housing 36 in a clockwise direction with respect to the cable housing 12.

Seen also in FIG. 2 is a second pin 60, an anchor pin which extends upward from the base 48 of the latch housing 36 in a direction parallel to the axis of the pin 46.

As seen in FIGS. 3*a* and 9, the latch housing 36 has an arcuate ridge 62 which extends about the periphery of the latch housing 36, the arcuate extent of the ridge being a few degrees less than 180° (e.g., 165°).

The ridge 62 is adapted to be received within the internal groove 52, thereby holding the latch housing 36 firmly in place and preventing movement relative of the latch housing 36 in an axial direction. If the latch housing 36 rotates 180° from the position shown in FIG. 9, the ridge 62 will be displaced from the groove 52, the latter being approximately 180° in arcuate extent, so that the latch housing 36 can be removed.

Figure 4:
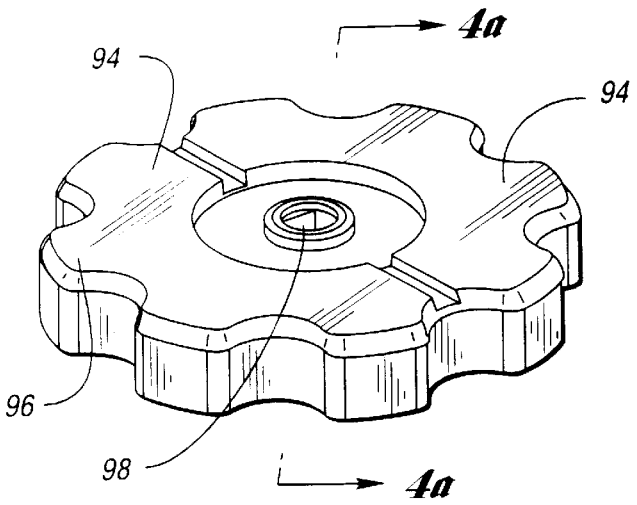
FIG. 4 is an isometric view of the cap that has been omitted from the assembly view of FIG. 2.
Figure 4A:
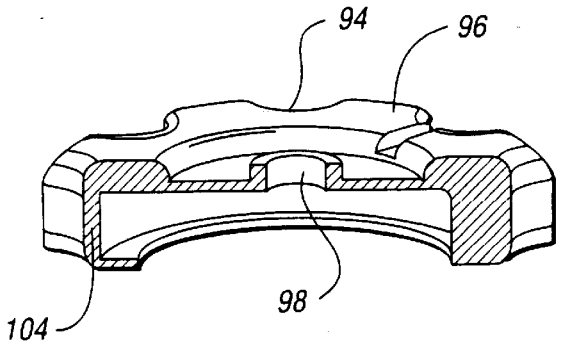
FIG. 4*a* is a cross-sectional view taken along the plane of section line 4*a* of FIG. 4.
Figure 5:
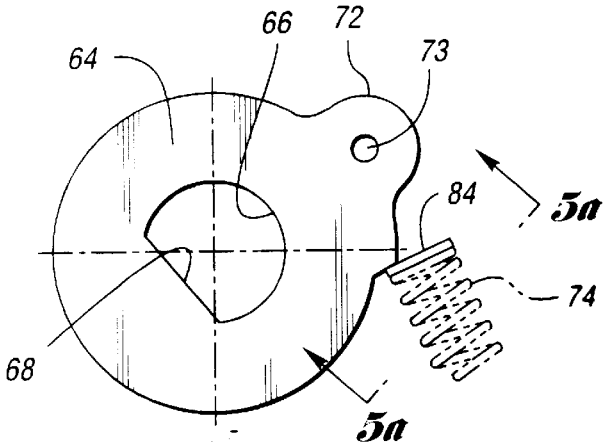
FIG. 5 is a top view of a crank that is located within the latch housing of FIG. 3.
Figure 5A:
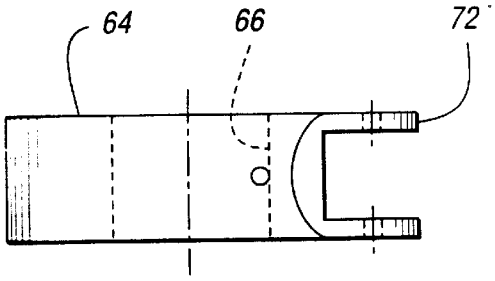
FIG. 5*a* is a side view of the crank shown in FIG. 5.
Figure 6A:
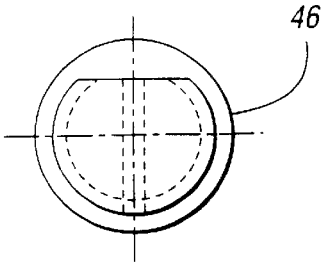
FIG. 6*a* is a top view of the pin shown in FIG. 6.

A crank 64 is shown in FIGS. 2, 5 and 9. It is adapted to be received in the interior cavity 42 of the latch housing. It is provided with a central opening 66 through which the pin 46 is received. As seen in FIGS. 2 and 5, the pin 46 is provided with a flat which registers with a corresponding flat 68 formed in the opening 66 of the crank 64, thereby permitting the crank to be driven by the pin 46 when the latter is rotated by the manually operable cap 94 to be described with reference to FIG. 4 and FIG. 4*a*.

Figure 7:
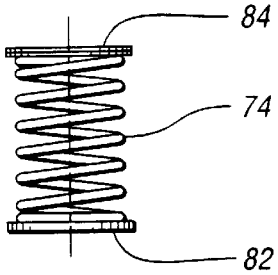
FIG. 7 is an end view of the spring, seen in the assembly view of FIG. 2, for controlling movement of the locking latch.
Figure 7A:
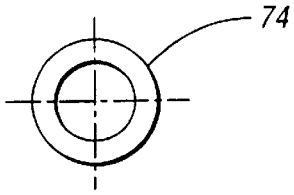
FIG. 7*a* is an elevational view of the spring seen in FIG. 2.
Figure 8:
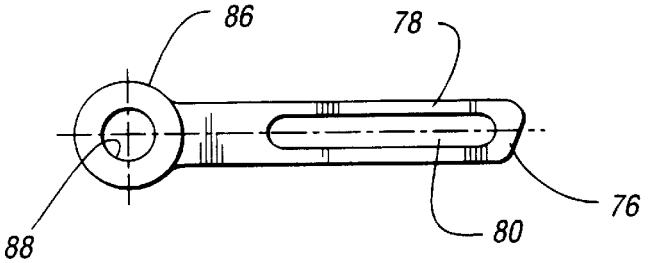
FIG. 8 is a top view of the latch seen in the assembly view of FIG. 2.
Figure 8A:
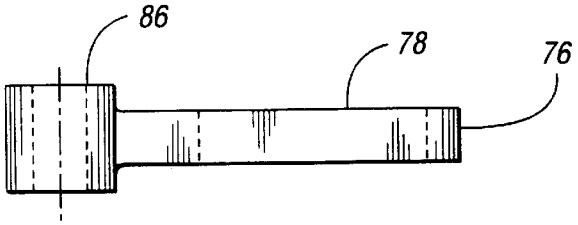
FIG. 8*a* is a side view of the latch of FIG. 8.

The crank 64 is provided with an off-center cam portion 70 which has a cam surface 72 surrounding a central opening 73. Cam surface 72 is engageable by one end of a compression spring 74 that surrounds a latch as illustrated in FIGS. 8 and 8*a* at 76. A detail of the spring 74 is shown in FIGS. 7 and 7*a*.

The latch 76 has an elongated body, as seen in FIG. 8 at 78. An elongated opening 80 in the elongated body 78 receives the pin 50 formed on the latch housing 36. One end 82 of the spring 74, when the spring is assembled as shown in FIG. 2, engages the pin 50. The other end 84 engages the cam surface 72 of the crank 64. The spring force acting on the crank 64 creates a clockwise moment when the parts are assembled, as shown in FIG. 2, so that the side of the cam 70 opposite the spring engages anchor pin 60.

The latch 76 includes an eyelet 86, best seen in FIG. 8 and FIG. 8*a,* which has a central opening 88. A pin extends through opening 88 and through opening 73 of the crank, as seen in FIG. 5, thereby establishing a pinned connection between the crank 64 and the latch 76.

When the latch housing 36 is positioned relative to the housing 2, as seen in FIG. 2, the latch 76 will engage one side 90 of the arcuate connector housing flange 18, thereby preventing counterclockwise movement of the latch housing 36 relative to the connector assembly 10 when the debris protection cover assembly is inserted as shown in FIG. 2. Similarly, with the parts assembled as shown in FIG. 2, pin 56 engages the opposite side 92 to limit clockwise rotation.

When the crank 64 is turned by the pin 3 in a counterclockwise direction with the parts assembled as shown in FIG. 2, the end 84 of the spring 74 and eyelet 86 of latch 76 will move over the cam surface 72. When an on-center condition is reached, the spring 74 is compressed and the pinned connection between the latch 76 and the crank 64, the center of the pin 46 and the pin 50 are aligned.

When the crank 64 is turned beyond the on-center position, the loading direction on the spring 74 is reversed to a counterclockwise direction, thereby moving the latch 76 from the locking position shown in FIG. 2. This permits the latch housing 36 to be rotated in a counterclockwise direction. Counterclockwise motion is imparted to the latch housing 36 upon rotation of the pin 46 by reason of the link connection provided by the latch eyelet 86 and by the pin 50, the latter moving through the elongated opening 80 of the latch portion 78.

As the latch housing 36 is rotated in a counterclockwise direction from the position shown in FIG. 2, the stop pin 56 will engage the end 90 of the connector housing flange 18, the end 90 acting as a stop. At that point, the latch housing arcuate ridge 62 will have been rotated out of the groove 52 so that the latch 76 no longer is locked against axial displacement relative to the cable housing 12. The cap assembly comprising the latch housing 36, the latch 76 and the pin 56 thus can be removed axially from the position shown in FIG. 2, thereby permitting access to the interior of the cable housing 12 to permit the operator to connect the cable ends as discussed previously with reference to FIGS. 1*a,* 1*b* and 1*c*.

The pin 46 is rotatable by the astronaut as a torque is applied to the pin 46 by the cap shown at 94 in FIGS. 4 and 4*a*. The cap 94 includes finger grip portions 96 to facilitate rotation of the cap when it is assembled on the pin 46.

The cap 94 has a central opening 98 which receives the pin 46. The opening 98 is provided with a flat that registers with the flat on the pin 46 previously described.

Figure 6:
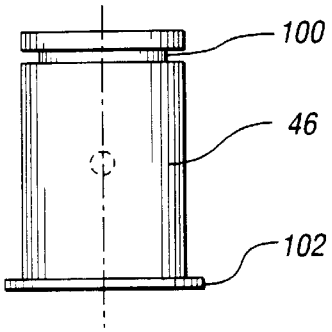
FIG. 6 is a side elevational view of a pin that is used to secure the cap and the latch housing together in assembled relationship.

The pin 46 has a retainer clip groove 100, best seen in FIG. 6, which receives a retainer clip after the cap 94 is assembled over the pin 46, thereby retaining the cap 94 in place and also keeping the crank 64 and the latch housing 36 in assembled relationship. Pin 46 is provided with a base flange 102, as seen in FIG. 6, which is engageable with the underside of the base 48 of the latch housing 36.

The cap 94, as seen in FIG. 4*a,* has an axially extending skirt 104 which extends downward over the connector housing flange 18.

As seen in FIGS. 2 and 9, the profile of the cover assembly is low, due to the enclosure of the latch housing 36 in the housing flange 18 and the reduced axial dimension of the cap 94 as seen in FIG. 4*a*.

Figure 3C:
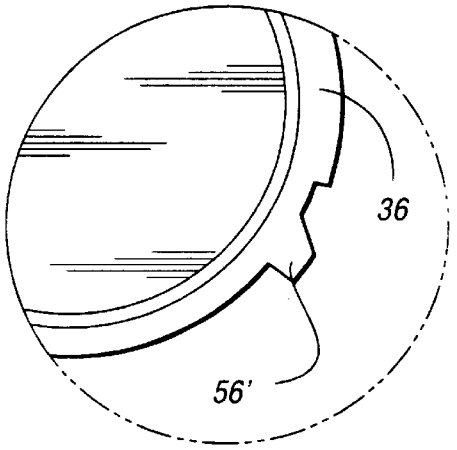
FIG. 3*c* is a detailed view of a portion of the latch housing of FIG. 3*a* which includes a modified locking element for securing the cap to the cable housing.

Shown in FIG. 3*c* is an alternate design for effecting a locking action similar to that provided by the pin 56, which was described with reference to FIG. 2. In the design of FIG. 3*c,* the pin 56 is eliminated and instead a step 56' is formed on the latch housing. The step 56' would extend radially at a position corresponding to the position of pin 56 in FIG. 2.

When the parts are assembled in the positions shown in FIG. 2, the step 56' would engage the end 92 of the connector body flange 18, thereby locking the latch housing against clockwise rotation from the position shown in FIG. 2. When the cap 94 is to be removed, as explained previously, the latch housing 36 would be rotated in a counterclockwise direction until the step 56' engages the end 90 of the connector housing flange 18.

While an embodiment of the invention has been illustrated and described, it is not intended that such disclosure will illustrate and describe all possible forms of the invention. It is intended that the following claims cover all modifications and alternative designs, and all equivalents, that fall within the spirit and scope of the invention.

What is claimed is:

1. A protective cover assembly for a cable housing containing electrical connections, the cover assembly comprising:

a cable end housing;

a latch housing with a circular periphery with a diameter sized to permit nesting engagement within the cable end housing;

an arcuate groove in the cable end housing extending partially about the periphery of the cable housing;

an arcuate shoulder on the latch housing extending partially about the periphery of the latch housing and received in the arcuate groove to lock the latch housing within the cable end housing;

the arcuate shoulder being displaced angularly from the groove upon angular adjustment of the latch housing to a cover assembly release position;

the cable end housing having two latch housing stops located thereon at peripherally spaced locations thereon;

an automatic latch assembly including an adjustable latch element carried by the latch housing and engaging one of the stops when the latch housing is in a cap assembly lock position;

a crank with a crank pin rotatably mounted on the latch housing including a cam portion pivoted to the latch element, the latter having an articulated connection with the latch housing, whereby the latch housing is rotated upon rotation of the crank in a direction to release the cap assembly; and a manually rotatable cap of generally circular configuration with an opening therein through which the crank pin is received, the cap being drivably connected to the crank pin to effect manual rotation of the crank and the latch housing between the cap lock position and the cap release position.

2. The cover assembly as set forth in claim 1 wherein the latch element articulated connection comprises a slot formed in the latch element, a pin carried by the latch housing and located in the slot, one end of the latch element being pivoted to the cam portion; and a spring surrounding the latch element having one end thereof seated on the cam portion and the other end thereof seated on the pin carried by the latch housing whereby the latch element is urged by the spring to a locking position against the one stop;

the cam portion, upon being rotated to an over-center position, permitting movement of the latch element from its locking position under the force of the spring thereby permitting rotation and removal of the latch housing and the cap from the cable end.

3. The cover assembly as set forth in claim 2 wherein the latch housing carries a stop element extending in a radial direction from the periphery of the latch housing, the stop element engaging the other of the latch housing stops when the cap assembly is in the locking position.

4. The cover assembly as set forth in claim 3 wherein the manually rotatable cap includes a hand grip portion to accommodate manual twisting movement of the cap about the axis of the assembly and an axially extending skirt portion surrounding the end of the housing end when the cap is assembled in place.

5. The cover assembly set forth in claim 4 including a mounting pin extending from the center of the latch housing, the latch having a central opening through which the mounting pin extends, the mounting pin extending through the crank and being drivably attached to the cap whereby rotation of the cap effects rotation motion of the latch housing between the locking and release positions.

6. A protective cover assembly for an electrical cable containing electrical connections, the cover assembly comprising:

a cable end housing;

a manually rotatable cap, a latch housing covering the cable end housing; and a latch mechanism located in the latch housing for locking the latch housing thereby preventing rotary motion of the latch housing relative to the cable end housing;

the latch housing and the cable end housing having interlocking portions, the interlocking portions preventing axial relative movement of the cover assembly when the latch housing assumes a locking condition at one angular position relative to the cable end housing, the interlocking portions permitting removal of the latch housing from the cable end housing when the latch housing assumes an unlocked condition at a second angular position relative to the cable end housing upon rotary motion of the latch housing relative to the cable end housing;

the latch mechanism being connected drivably to the cap whereby the latch mechanism unlocks the latch housing from the cable end housing upon manual rotation of the cap, the latter being drivably coupled to the latch mechanism.

7. The protective cover assembly set forth in claim 6 wherein the latch mechanism comprises a latch element engageable with the cable end housing upon rotation of the cap in one direction thereby preventing rotary movement of the latch housing relative to the cable end housing in one direction, and a mechanical stop for preventing movement of the latch housing relative to the cable end housing in the opposite direction, the latch housing, when assembled, being enclosed within the cable end housing, the rotatable cap having a low profile to effect economy of space and accommodating rotation of the latch housing when manually assembling and removing the latch housing without the necessity to exert an axial force on the cap.

8. The protective cover assembly set forth in claim 7 wherein the latch mechanism comprises a crank drivably connected to the cap, the latch element being connected drivably to the crank.

9. A protective cover assembly for an electrical cable containing electrical connections, the cover assembly comprising:

a cable end housing;

a latch housing covering the cable end housing; and a latch mechanism located in the latch housing for locking the latch housing thereby preventing rotary motion of the latch housing relative to the cable end housing;

the latch housing and the cable end housing having interlocking portions, the interlocking portions preventing axial relative movement of the cover assembly when the latch housing assumes a locking condition at one angular position relative to the cable end housing, the interlocking portions permitting removal of the latch housing from the cable end housing when the latch housing assumes an unlocked condition at a second angular position relative to the end housing upon rotary motion of the latch housing relative to the cable end housing; and means for actuating the latch mechanism and for mechanically rotating the latch housing relative to the cable end housing between the locking and unlocked conditions.

* * * * *